United States Patent [19]

Krenz

[11] 4,423,975

[45] Jan. 3, 1984

[54] FORM TRIMMING APPARATUS AND METHOD FOR LINE PRINTER

[75] Inventor: Horst M. Krenz, St. Joseph, Mich.

[73] Assignee: Heath Company, St. Joseph, Mich.

[21] Appl. No.: 387,092

[22] Filed: Jun. 10, 1982

[51] Int. Cl.[3] ..... B41J 11/26

[52] U.S. Cl. ..... 400/616; 400/621.1; 225/99

[58] Field of Search ..... 225/99, 98; 400/616, 400/616.1, 616.2, 616.3, 621.1

[56] References Cited

U.S. PATENT DOCUMENTS

| | | | |
|---|---|---|---|
| 2,208,994 | 7/1940 | Mabon | 225/99 X |
| 2,308,551 | 1/1943 | Sherman | 225/99 X |
| 3,795,298 | 3/1974 | Kodis | 400/124 |

*Primary Examiner*—Paul T. Sewell
*Assistant Examiner*—Charles A. Pearson

[57] ABSTRACT

In a line printer, form trimming apparatus for automatically separating paper-drive edge perforated tear strips from a continuous paper form comprises a trimmer having hold-down sections which include slots for receiving the sprocket of a paper driver to permit those sections to hold the edge perforated strips against the sprocket to enable the sprocket to draw the form past a print head. A ramp extends at an acute angle from the hold-down sections to ramp the center section of the form upwardly and away from the tear strip. The ramp includes an edge that projects below the level of the hold-down section to facilitate automatic separation of the tear strips from the center section of the form as the form passes through the line printer.

1 Claim, 8 Drawing Figures

FORM TRIMMING APPARATUS AND METHOD FOR LINE PRINTER

BACKGROUND OF THE INVENTION

This invention relates to computer printers, and is particularly concerned with improved means for enhancing the utility of high-speed line printers.

Line printers are peripheral to computer systems, proving primarily for alphanumeric "hard copy" output. Printing speed is usually very high, ranging from 130 to 300 lines per minute. The print medium may be, for example, a fan-fold, edge-punched continuous paper form, usually loaded in large quantities because of the high output of the printer.

The print medium is provided to the high-speed printer from a paper supply which generally feeds a continuous roll of paper in which the individual sheets are distinguished by perforated tear-off lines. This print medium feed configuration avoids the necessity of providing individual print medium sheets to the printer. The print medium is generally moved by means of a "tractor" mechanism which comprises pairs of sprockets or cog wheels, each having a plurality of teeth around its periphery for engagement with a linear array of perforations positioned at either side of the continuous print medium strip. In bi-directional line printers, there are normally two pairs of tractors, one being a lower tractor mechanism located between the paper supply and the print head for urging the form upward past the print-head, and an upper drive mechanism for pulling the print medium past the print head toward the print storage location.

Some types of continuous forms, such as those which contain invoices, are designed to be torn out after printing for further processing. Forms of this type, which are usually relatively narrow, have perforated strips on either side which, upon engagement with the tractors, provide for moving the invoice form through the machine. The invoice form also has a horizontal tear strip for removing the form from the machine when printed. After removal, it is is necessary to tear off the strips on either side by hand, which is a tedious and time-consuming operation inconsonant with the high-speed operation of the line printer.

OBJECTS OF THE INVENTION

It is a general object of this invention to provide means for enhancing the utility of line printers.

It is a more specific object of the invention to simplify the handling of fan-fold, edge-punched continuous tear-out forms.

It is a specific object of the invention to simplify the handling of tear-out forms in line printers.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
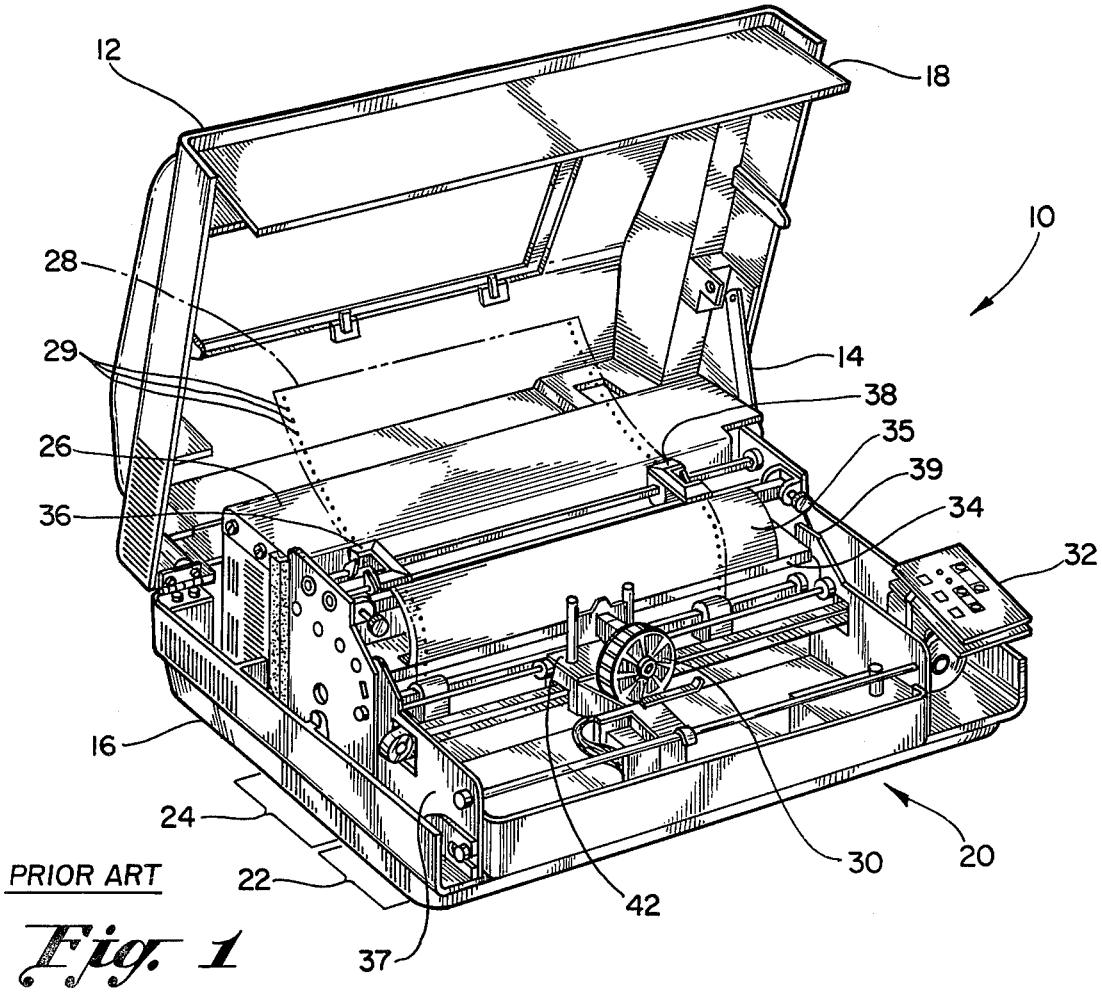
FIG. 1 is a view in perspective depicting a line printer ready for operation.

A high-speed line printer 10 of a type to which the present invention has application is shown by FIG. 1. Cover 12 is depicted as being raised and held in an open position by cover support arm 14, which has a detented member for locking cover 12 in the open position.

The component parts of the line printer 10 are depicted as being installed in a base cabinet 16 which mates with cover 12 upon closure of cover 12. Cover 12 will be noted as having an overhanging panel 18 which enters a recess 20 at the front of base cabinet 16 when the cover is closed.

Line printer 10 consists of three basic assemblies—a print drive unit 22, a paper drive unit 24, as indicated by the brackets, and an electronic circuit assembly 26, shown as being covered. The print drive unit 22 and paper drive unit 24 act in concert to print characters on a print medium 28, usually paper, that is drawn between the print head 30 and platen 34 of the print drive unit 22 by the paper drive unit 24.

The electronic circuit assembly 26 contains components for interfacing with a computer (not shown) to which the line printer 10 is peripheral. A multi-conductor electrical cable (not shown) links the line printer 10 and the computer, carrying the computer's instructions to line printer 10, and information about the line printer's status back to the computer. The primary component of the electronic circuit assembly 26 is generally a microprocessor which receives and interprets the instructions from the computer, controls the print head and paper advance motors, tells the computer when to send more information, and controls the flow of information inside the line printer 10. Other components in the line printer 10 are directed by the microprocessor to switch the internal voltages and currents for rapid, precise control of the printhead drive motor, paper advance motor, and ribbon advance motor. The controls and indicators which govern the operation of the line printer 10 are contained on control panel 32.

The print medium 28, noted as normally being paper, and hereafter referred to as paper, is normally supplied to the line printer 10 from a "fan-fold" or a continuous roll in which individual sheets are distinguished by edge perforations 29 lateral to the length of the paper and adjacent to the edges of the paper. The paper 28 is normally stored in a dispenser, usually in a cabinet or stand which supports the line printer 10. Line printer 10 has an upper paper drive mechanism comprising a pair of paper tractor members 36 and 38, each including sprocket means for engaging the edge perforations 29 in the paper 28 that extend along each edge.

Figure 1A:
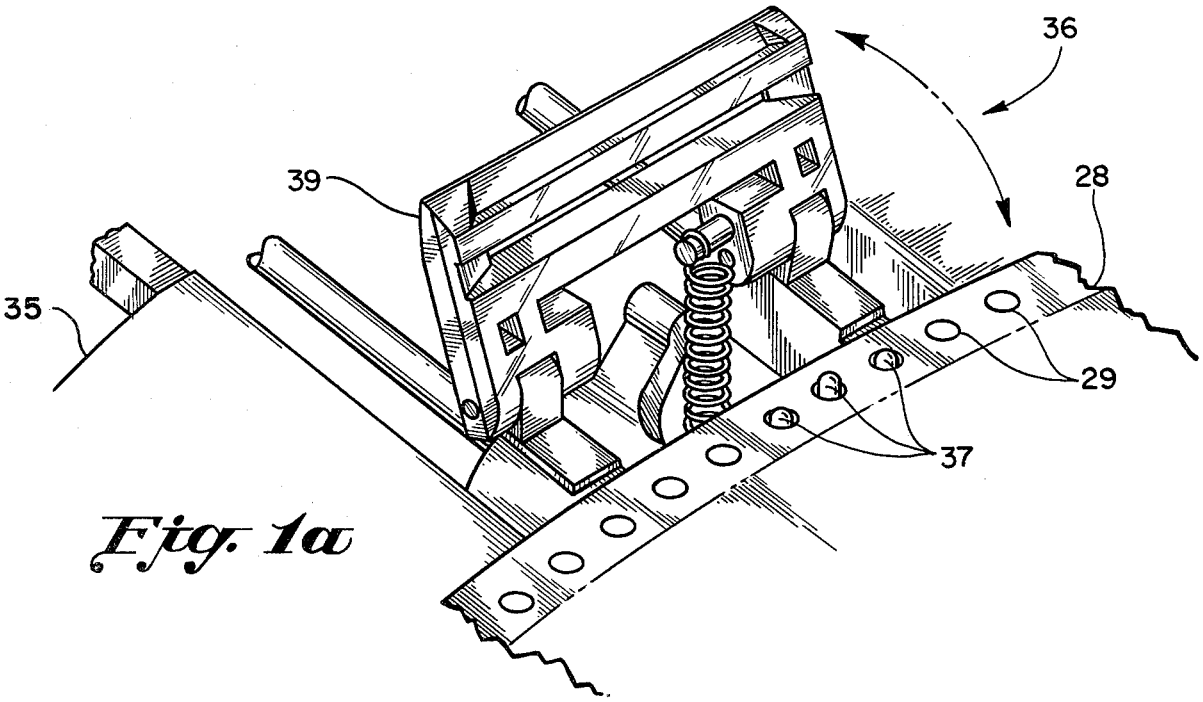
FIG. 1A is an enlarged, perspective view showing a detail of the printer depicted in FIG. 1.

Tractor member 36 is shown in greater detail in FIG. 1A; member 38 is its identical, but oppositely facing, counterpart. Sprocket means 37 are shown in protrusion for engaging the edge perforations 29 of the paper 28 for pulling the paper 28 past and over the paper guide 35, which in the line printer indicated, is indicated as being an arcuate paper guide. Tractor means 36 is depicted as having an outwardly swinging cover 39 for opening and receiving paper 28, and closing for retaining sprocket means 37 in engagement with the edge perforations 29. A lower paper drive mechanism having tractor members similar to those described is typically located beneath the area of the platen 34, but is not shown in FIG. 1. The tractors can be moved parallel to platen 34 to accommodate forms and print media of different widths.

As the paper 28 moves upwardly a line at a time or several lines at a time, characters are printed on the paper 28 by the print head 30, which traverses between a first side frame and a second side frame of print drive unit 22. The paper 28 normally moves upwardly between an inked ribbon (not shown) and the platen 34.

Print head 30 is typically a standard impact printer which includes a vertically aligned array of print wires. Each wire of the array is selectively electromagnetically activated to advance toward platen 34 for printing characters, typically of dot-matrix form, through the inked ribbon onto paper 28. The selectively activated wires produce a matrix of dots representing a desired character, for example, the letter A or the numeral 2.

The print head 30 is located on a carriage 42. Carriage 42 traverses parallel to the platen 34 for printing the characters.

Figure 2:
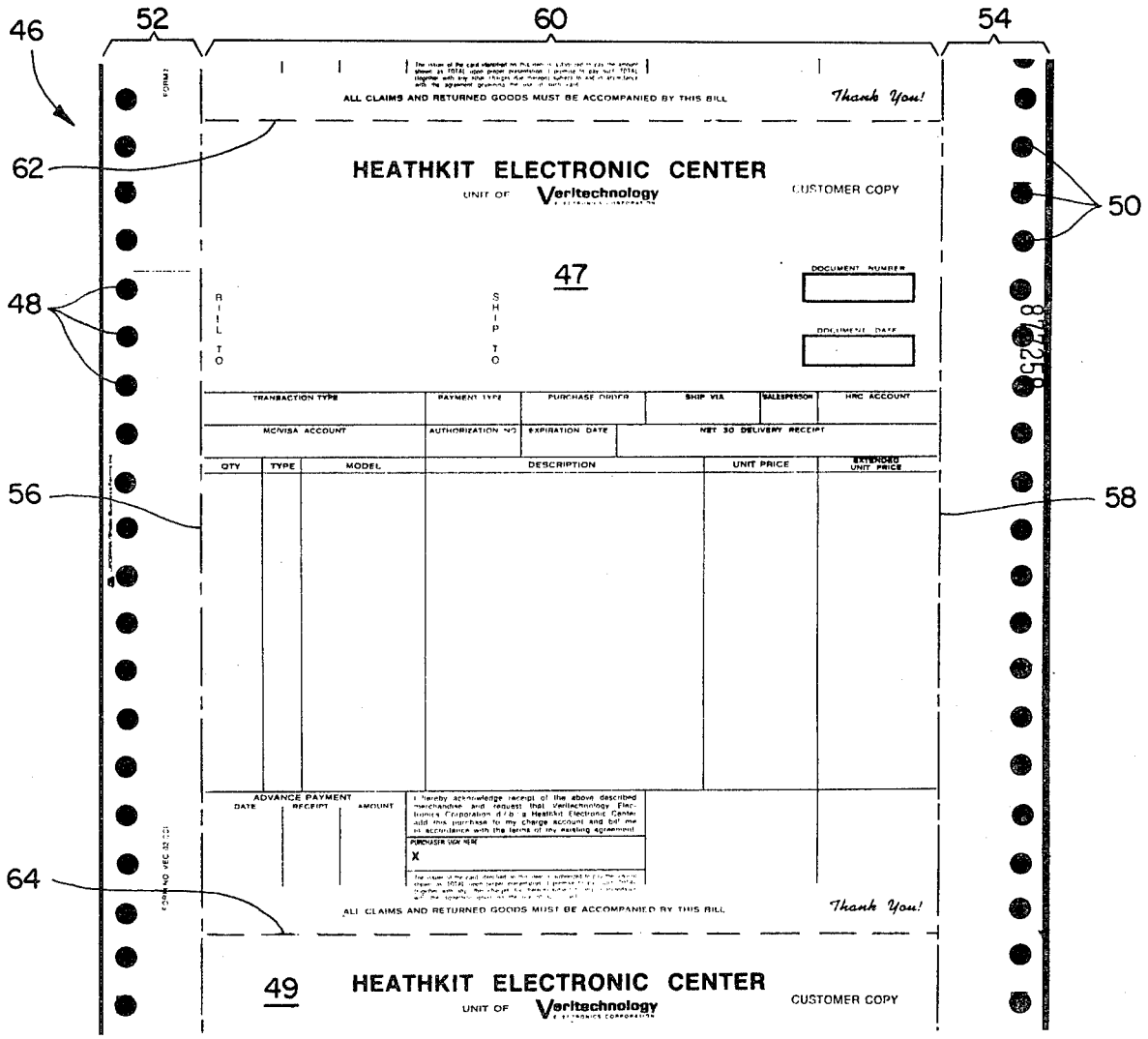
FIG. 2 is a reproduction of a section, reduced in size, of an edge-punched continuous paper form.

The paper 28 may comprise a continuous paper form 46 as depicted in FIG. 2, and made up of a manifolded series of invoices 47 and 49 with interleaved carbon paper for processing by the associated computer, and printing by line printer 10. Form 46 is shown as having a series of edge perforations 48 and 50 for engagement with the sprocket means of the tractor members 36 and 38 which pull form 46 past print head 30 and over paper guide 35, indicated as being arcuate. Form 46 is also shown as having laterally oriented, discardable paper-drive tear strips 52 and 54 adjacent each edge; the tear strips are indicated by the brackets. The form 46 is semi-perforated as indicated along lines 56 and 58 to provide for the separation of the tear strips 52 and 54 by hand from the center section 60 of form 46. Sequential tear strips 62 and 64 perpendicular to the edges provide for removing each invoice when printing is completed.

Figure 3A:
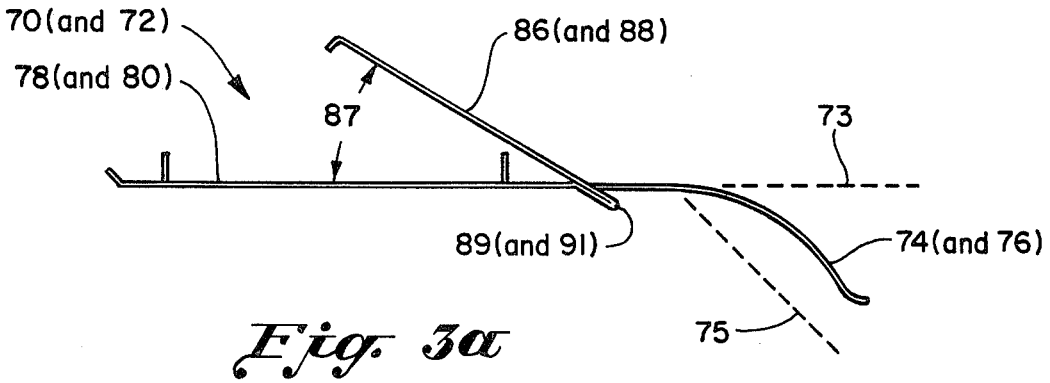
FIG. 3A is a plan view showing a detail of the embodiment depicted in FIG. 3.
Figure 3:
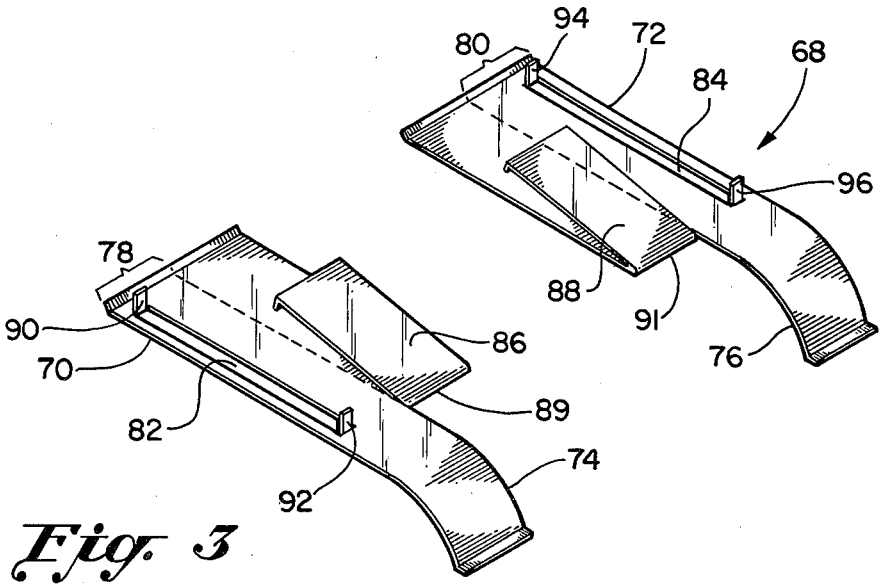
FIG. 3 is a perspective view of a preferred embodiment of the form trimming apparatus according to the invention.

A preferred embodiment of a form-trimming apparatus 68 according to the invention for automatically separating tear strips 52 and 54 from the center section 60 of form 46 is depicted in FIG. 3. The form-trimming apparatus, in its preferred embodiment, is shown as comprising two discrete trimmers—a left-side trimmer 70, and a right-side trimmer 72 for captivation under the hinged covers of the tractor members 36 and 38. The benefit of having two discrete trimmers according to the invention is that form of different widths can be accommodated.

Form trimmers 70 and 72 include tear strip hold-down means indicated as having, in the embodiment of the invention, arcuate sections 74 and 76 for holding, respectively, tear strips 52 and 54 of form 46 down on the arcuate paper guide 35 of line printer 10. Hold-down means 70 and 72 are depicted as having respective flat sections 78 and 80 including slot means 82 and 84 for passing the sprocket means of the tractor members 36 and 38. The flat sections 78 and 80 provide for holding the edge-perforations 48 and 50 of form 46 in contact with the sprocket means for drawing form 46 past print head 30.

The respective ramp means 86 and 88 are indicated in FIG. 3A as extending at a non-zero acute angle 87 from hold-down means 78 and 80. Ramp means 86 and 88 are effective to ramp center section 60 of form 46 upwardly and away from tear strips 52 and 54. Ramp means 86 and 88 include an extending edge 89 and 91 indicated in FIG. 3A projecting below the level of the hold-down strips 78 and 80 for facilitating the separation of the tear strips 52 and 54.

The beneficial time-saving effect is such that, according to the invention, tear strips 52 and 54 are automatically separated from center section 60 of form 46 during traverse of the form 46 through the printer 10.

Upstanding tabs 90 and 92, and 94 and 96, will be noted at each of the ends of the respective slot means 82 and 84 of the flat sections 78 and 80. The tabs provide for engaging the ends of the covers 39 of tractor members 36 and 38, see FIG. 4, for retaining the form trimmers 70 and 72 in proper position during operation of the printer 10.

The non-zero, acute angle of the ramp means may be, for example, an angle of about thirty degrees as measured from the plane of the respective hold-down means 78 and 80.

In the embodiment of the invention depicted in FIG. 3A, form trimmers 70 and 72 are indicated as having arcuate sections 74 and 76 for holding tear strips 52 and 54 down on the arcuate paper guide 35 of line printer 10. The arcuate paper guide 35 may be considered as being typical of the line printer 10 shown by way of example. Other makes of line printer may have a paper guide formed as a straight-line section, or a guide at an angle of forty-five degrees, for example. The form trimmers according to the invention may as well have a straight-line paper guide section 73, as indicated by the dash lines. Alternately, the hold-down section of the form separator according to the invention, may be at an angle of forty-five degrees to conform to a printer having a paper guide at such an angle, as indicated by the dash lines and reference No. 75.

Figure 4:
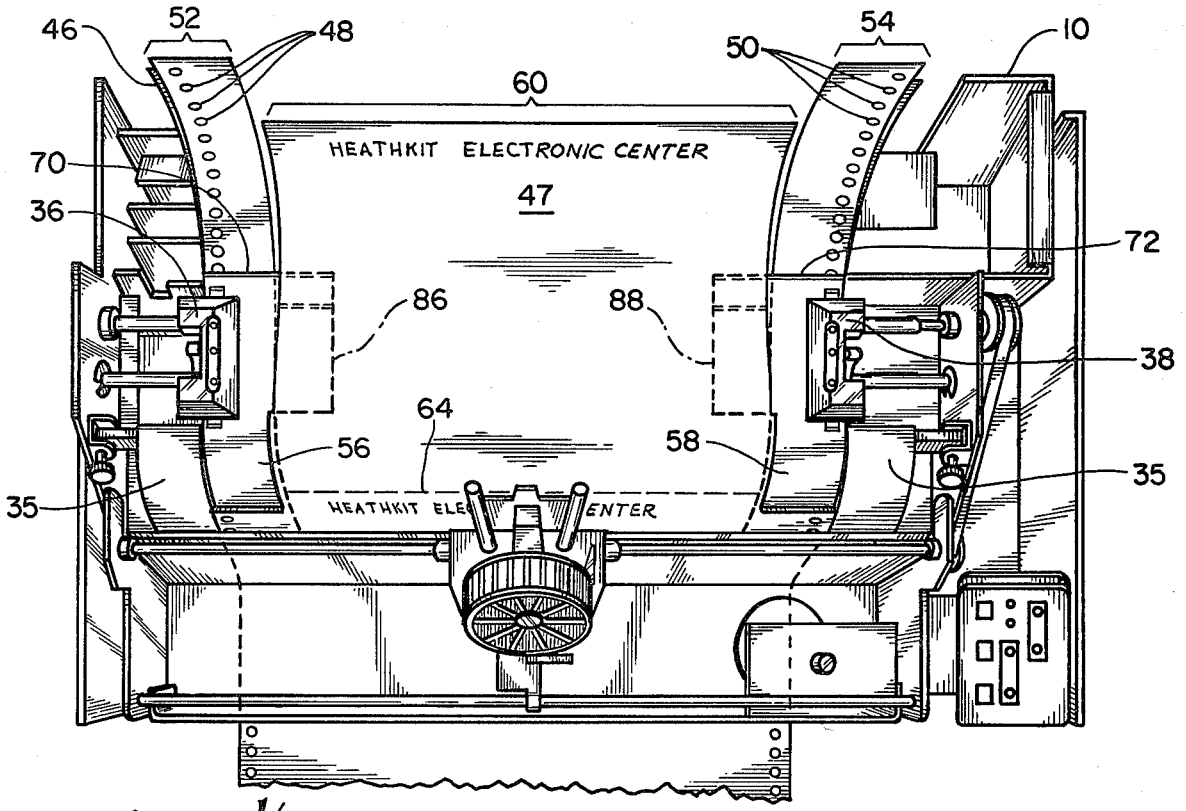
FIG. 4 is a view in perspective of a line printer with a form-trimming apparatus according to the invention as installed.
Figure 5:
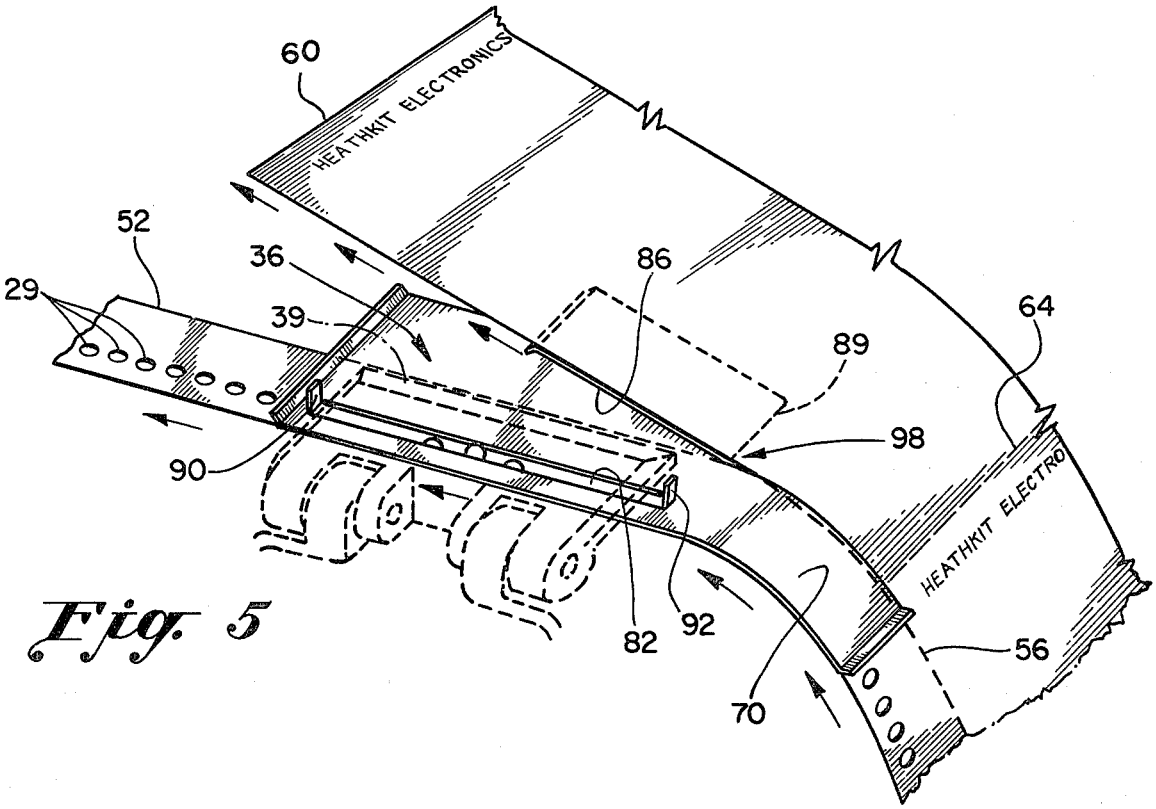
FIG. 5 is a perspective view of a form-trimming apparatus according to the invention indicating details of the form-trimming action.

The form-trimmer apparatus 68 according to the invention is depicted as installed in line printer 10 in FIG. 4. Edge perforated, manifolded continuous paper form 46, shown by FIG. 2 and described as comprising a series of invoice forms, is inserted in the paper feed slot in the base of the printer 10. The covers of the tractor members 36 and 38 are swung open, and the edge perforations 48 and 50 of form 60 are placed over the sprocket means. The form trimmers 70 and 72 are then installed, with the sprockets projecting through the respective slots 82 and 84, after which the covers of the tractor means are closed. Reference is now directed to FIG. 5, wherein the left-side trimmer 70 according to the invention is depicted. The center section 60 of form 46 is manually separated along tear strip 56 (and tear strip 58 opposite), and the center section 60 is fed over ramp 86 (and ramp 88 opposite). When printer 10 is turned on, tear strips 52 and 58 are automatically separated according to the invention from the center section 60 during traverse of form 46 through the printer. The point of separation of tear strip 52 and center section 60 is approximately at point 98. The separation is a gentle one—there is no cutting or tearing per se, but rather an easy disengagement of tear strip 52 from center section 60 along the line of perforation 56. The extending edges 89 and 91, which are indicated as projecting below the level of the hold-down means 78 and 80, are essential in facilitating the shearing of the tear strip 52 and 54 from the center section 60 of form 46. The extending edges prevent, according to the invention, the edge of center section 60 that intersects the leading edge of the ramp means 86 and 88 from "running under" the ramp means 86 and 88, and in effect, gently urges the shearing of the tear strips 52 and 54 from the center section 60. The edges may extend a distance of about one-eighth of an inch below the level of the hold-down means, by way of example.

Upon completion of the processing and printing of the invoice, the invoice is manually torn off at tear strip 64. The tear strips 52 and 54 can be received in a basket for eventual discard.

Figure 6:
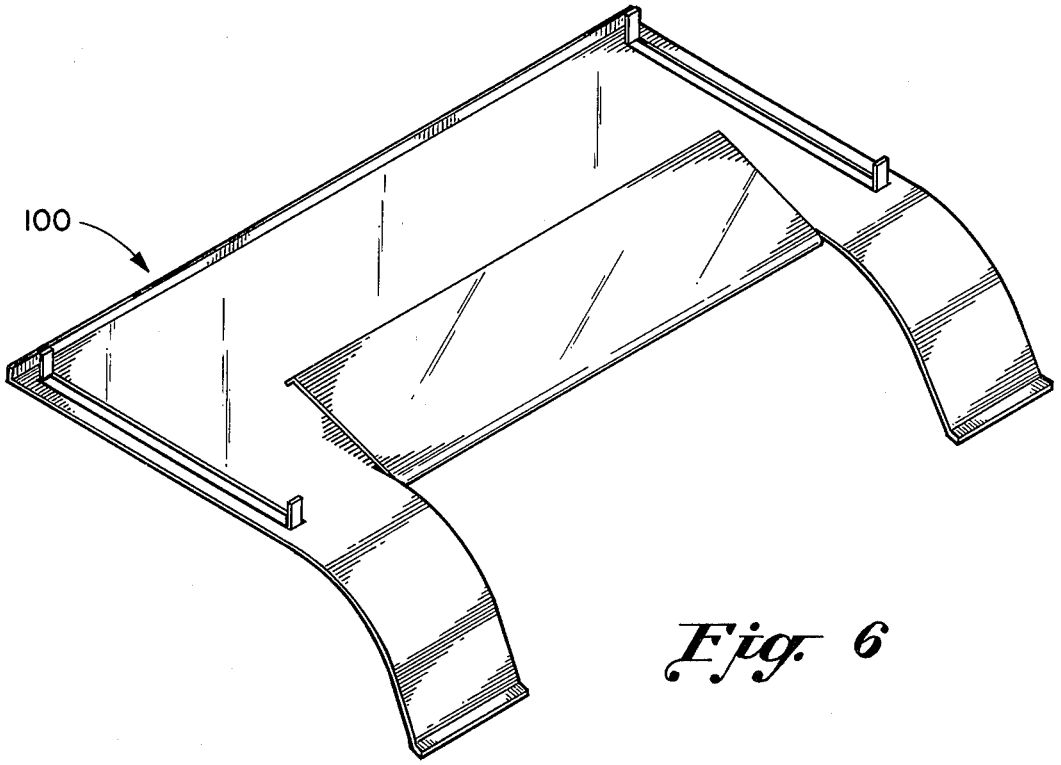
FIG. 6 is a perspective view of another embodiment of the form-trimming apparatus according to the invention.

Another embodiment of the invention is shown by FIG. 6, indicated as comprising a single, unitary form-trimming apparatus 100 for trimming a form of a specific width. Form-trimming apparatus of the unitary type indicated by FIG. 6 are recommended when only one or two forms having different widths need be commonly processed.

The material of the form-trimming apparatus according to the invention can be a stainless steel strip having a thickness of about 12 mils, for example. Optimum dimensions of both the form trimmer shown by FIG. 3 and by FIG. 6 are determined by the make of the line printer on which they will be used; such dimensions can easily be determined by ones skilled in the art for the particular line printer for which the form trimmers according to the invention are intended.

It is to be noted that the form trimming apparatus according to the invention works with any type of line printer having standard drives. There is no interference with machine operation, and the cover can be closed when the apparatus is installed. The apparatus is easy to install and remove, and inexpensive. Also, the apparatus is durable and requires no maintenance.

The method according to the invention for automatically separating the tear strips 52 and 54 from the center section 60 of form 46 comprises the following. The covers of the tractor means 36 and 38 are opened and the form is inserted in the printer. Two discrete form trimmers 70 and 72 are provided having tear strip hold-down means including slots 82 and 84 for passing the sprocket means. The sprocket means are passed through the slots of said hold-down means and the covers are closed. The center section 60 of form 46 is ramped upwardly and away from the tear strips 52 and 54 at an angle of about 30 degrees by ramp means 86 and 88 extending from the hold-down means 78 and 80. The ramp means is extended about one-eighth inch below of the hold-down means for facilitating the shearing of the center section 60 from form 46. The effect according to the inventive method is such that the tear strips are automatically separated from the center section of the form during traverse of the form through the line printer.

While particular embodiments of the invention have been shown and described, changes and modifications may be made without departing from the invention in its broader aspects, and therefore, the aim of the appended claims is to cover all such changes and modifications as fall within the true spirit and scope of the invention.

I claim:

1. For use in a line printer having a print head on a carriage traversing parallel to a platen for printing characters through an inked ribbon onto an edge-perforated continuous paper form having a laterally oriented, discardable paper-drive tear strip adjacent to each edge for separation from the center section of said form, said printer including two paper tractor members each including sprocket means for engaging the edge perforations for pulling said form over an arcuate paper guide and past said print head, each of said tractor members having an outwardly swinging cover for opening and receiving said form, and upon closing, for retaining said sprocket means in engagement with said edge perforations of said form, a form-trimming apparatus for automatically separating the tear strips from said center section comprising:

two discrete form trimmers individually captivated under said hinged cover of an associated tractor member, each form trimmer including;

tear strip hold-down means having an arcuate section for holding said tear strips against said arcuate paper guide, and a flat section including slot means for passing said sprocket means to permit said flat section to hold said edge perforations of said tear strips in contact with said sprocket means to enable said sprocket means to draw said form past said print head, said flat section further including an upstanding tab at each end of said slot means engageable with the cover of an associated one of said tractor members for retaining said form trimmer in proper position during operation of the printer;

ramp means extending at an acute angle from said flat section of said hold-down means effective to ramp said center section of said form upwardly and away from said tear strips, said ramp means including an edge extending below the level of said flat section of said hold-down means for facilitating the shearing of said tear strips;

such that said tear strips are automatically separated from said center section of said form during traverse of said form through said line printer.

* * * * *